United States Patent [19]

Hughes et al.

[11] 4,165,969

[45] Aug. 28, 1979

[54] HIGH CARBON CONTENT LIQUID FUELS

[75] Inventors: Leonard Hughes, Columbus; Kenneth R. Robinson, Worthington; Marvin L. Deviney, Jr., Columbus, all of Ohio

[73] Assignee: Ashland Oil, Inc., Ashland, Ky.

[21] Appl. No.: 950,347

[22] Filed: Oct. 11, 1978

Related U.S. Application Data

[63] Continuation of Ser. No. 824,184, Aug. 12, 1977, abandoned, which is a continuation of Ser. No. 521,050, Nov. 5, 1974, abandoned, which is a continuation of Ser. No. 335,243, Feb. 23, 1973, abandoned.

[51] Int. Cl.[2] ..... C10L 1/32

[52] U.S. Cl. ..... 44/51

[58] Field of Search ..... 44/51; 302/66

[56] References Cited

U.S. PATENT DOCUMENTS

| | | | |
|---|---|---|---|
| 2,176,879 | 10/1939 | Bartell | 44/51 |
| 2,754,267 | 7/1956 | Bondi | 44/51 |
| 3,043,708 | 7/1962 | Watson et al. | 106/307 |

*Primary Examiner*—Winston A. Douglas
*Assistant Examiner*—Y. Harris-Smith
*Attorney, Agent, or Firm*—Van D. Harrison, Jr.

[57] ABSTRACT

Disclosed is a high-carbon-content liquid hydrocarbon fuel wherein particulated carbon such as carbon black, having organic groups or components attached to the surfaces thereof, is dispersed in a liquid hydrocarbon fuel. Disclosed also is a method for making the high-carbon-content liquid hydrocarbon fuel wherein organic components are graft-polymerized to carbon black dispersed in a liquid hydrocarbon fuel.

1 Claim, No Drawings

HIGH CARBON CONTENT LIQUID FUELS

RELATED APPLICATIONS

This application is a continuation of Ser. No. 824,184, filed Aug. 12, 1977, now abandoned which was a continuation of Ser. No. 521,050, filed Nov. 5, 1974 now abandoned. The latter in turn constituting a continuation-in-part of Ser. No. 335,243, filed Feb. 23, 1973, now abandoned.

FIELD OF THE INVENTION

This invention relates to liquid fuels for propelling aircraft, rockets and the like. More specifically it is concerned with liquid fuels containing finely divided carbon particles dispersed therein.

DESCRIPTION OF THE PRIOR ART

The development of ramjet engines has shown that as their range increases, propellant fuels of increased volumetric heating value (heat of combustion per unit volume) are necessary. Generally the volumetric heating values of liquid hydrocarbon fuels increase with increased carbon-to-hydrogen ratios in the fuels and increased densities. It has been proposed in the prior art to increase the carbon content and densities of liquid hydrocarbon fuels, and consequently their volumetric heating values, by dispersing in them finely divided carbon, such as carbon black or powdered graphite. Studies have been made with carbon blacks suspended in such hydrocarbon fuels as kerosene, decalin and tetralin. In some of these studies gelling agents, such as an aluminum soap of isooctanoic acid or the Dow Chemical Company proprietary material tradenamed CX 3487, have been utilized to keep the carbon black dispersed in the hydrocarbon fuel. These hydrocarbon fuel carbon black mixtures, however, exhibit marked increases in viscosity in comparison to the liquid hydrocarbon fuel alone. Liquid fuels containing particulated aluminum and boron to increase their volumetric heating value have also been investigated. The metal oxides formed in combusting these fuels has, however, interfered with engine efficiencies and has shown these fuels to have only limited applicability.

Turning now to other considerations, studies of carbon black have demonstrated that hydrocarbon groups or polymers can be attached through carbon-to-carbon bonds to the surfaces of carbon black particles. U.S. Pat. No. 3,043,708 discloses a method wherein hydrocarbon groups can be attached to the surfaces of carbon black particles utilizing Friedel-Crafts alkylating agents and catalysts. These modified carbon blacks are said to be useful for reinforcing rubber compositions. Other studies of carbon black have shown that various monomers can be graft-polymerized onto carbon black particles. For example, when styrene is added to carbon black and is thermally polymerized, a reaction product of styrene polymer grafted onto the surface of carbon black particles is obtained.

A primary object of this invention is to provide a liquid hydrocarbon fuel containing dispersed carbon particles and having a high volumetric heating value. A further object of this invention is to provide a method of making a liquid hydrocarbon fuel containing dispersed carbon particles and having a high volumetric heating value. A still further object of this invention is to provide a method of increasing the stability of the dispersed carbon black in a liquid hydrocarbon fuel containing dispersed carbon particles. A further object is to provide a fuel of this description having a depressed pour-point and reduced viscosities in comparison to prior art carbon black liquid fuel mixtures.

SUMMARY OF THE INVENTION

This invention constitutes a hydrocarbon fuel consisting essentially of a liquid combustible hydrocarbon, having dispersed therein carbon black particles to whose surfaces hydrocarbon groups are chemically attached or polymer groups are graft-polymerized. The fuel composition of this invention may also contain catalyst residue and/or self polymers of the monomer material making up the grafted-polymer, but these are not essential components of the composition.

This invention further constitutes a method of preparing a high-carbon-content hydrocarbon fuel wherein particulated carbon black, a polymerizable, graftable monomer and a polymerization initiator are mixed in a liquid hydrocarbon fuel medium and the resulting mixture is reacted at proper conditions of temperature and pressure to accomplish graft-polymerization of at least a portion of the added monomer to the carbon black.

DESCRIPTION OF PREFERRED EMBODIMENTS

Although the emphasis in the following description is on liquid hydrocarbon fuel-carbon black-grafted polymer compositions and a method of preparing them, the scope of this invention also includes compositions comprising liquid hydrocarbon fuels and carbon black, the latter having attached to its surfaces hydrocarbon radicals. The hydrocarbon radicals may have been attached by utilizing Friedel-Crafts, Grignard, or other conventional reactions, as well as polymerization type reactions such as Ziegler-Natta, anionic, cationic, radiation-induced, and peroxide-initiated reactions.

LIQUID HYDROCARBON FUEL

The liquid hydrocarbon component may be any combustible liquid hydrocarbon. Preferred hydrocarbon liquids are those having a high density and high carbon-to-hydrogen ratio such as kerosene, the JP-5, RP-1, or Shelldyne fuels, decalin or tetralin. "JP-5", "RP-1", and "Shelldyne" is a trademark of Shell Oil Company for mixtures of unsaturated bicyclo (2.2.1) hepta-2, 5-diene dimers. A preferred hydrocarbon liquid is a hydrogenated dimer of methylcyclopentadienes having the following structure:

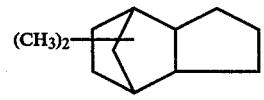

CARBON BLACK

A wide variety of carbon blacks may be dispersed in the liquid hydrocarbon fuel. These include thermal blacks of various particle sizes, furnace blacks, and channel blacks. Usable furnace blacks include the classes designated as super abrasion, high abrasion, fast extrusion, fine, and carcass grade of various particle sizes. Classes of channel blacks usable are medium processing, hard processing and conducting. Carbon black produced from acetylene and the various graphitized blacks may also be used. Blacks of smaller particle size will combust easily but will tend to increase the viscosity of the resulting fuel-carbon black mixture, whereas carbon black of greater particle size will increase the viscosity less at corresponding concentrations but will not combust as rapidly. It will therefore be necessary usually to choose a carbon black of intermediate particle size to optimize the burning and viscosity characteristics of the resulting carbon black-liquid hydrocarbon mixture.

A preferred carbon black is a semi-reinforcing black (SRF) having the following properties:

| ASTM No. | N-754 | |
|---|---|---|
| Iodine Adsorption, mg./gm | 20–27 | |
| Tint | 188–200 | |
| DBP adsorption, cc/100 gm | 54–62 | |
| Ash, % | 0.75 | Maximum |
| 30 Mesh Residue, % | 0.001 | Maximum |
| 325 Mesh Residue, % | 0.050 | Maximum |

MONOMER

The monomer to be graft-polymerized onto the particles of polymerizable black can be a number of those now commercially available. It is believed that the mechanism of graft-polymerization consists of two steps. In the first step, the molecules of monomer polymerize to form a polymer chain. Subsequently, the reactive end of the polymer chain attaches to the surface of the carbon black. Consequently, the monomer selected should be one that will yield a desired carbon black-grafted-polymer having hydrocarbon moieties compatible with the hydrocarbon fuel component in which the carbon black is dispersed. Specifically, monomers which can be used include vinyl esters, esters of acrylic and substituted acrylic acids, and polymerizable hydrocarbons containing a hydrocarbon moiety which will be compatible with the liquid hydrocarbon fuel component. Other usable monomers include diene monomers such as isoprene and butadiene, cyclic dienes such as cyclopentadiene, and cyclic hydrocarbons containing multiple unsaturation (conjugated or unconjugated). Ideal monomers would be those containing moieties similar to the liquid hydrocarbon fuel component such as vinyl hydrogenated dimers of methylcyclopentadienes, vinyl Shelldyne-type hydrocarbons (mixtures of vinyl-substituted unsaturated bicyclo (2.2.1) hepta-2,5-diene dimers), vinyl cuban (vinyl-substituted compounds of pentacyclo (4.2.0.02,50.3,80.4,7) octane), and vinyl binor-S (vinyl-substituted compounds of heptacyclo (5.5.1.12,6.14,12.19,11.03,5.08,10)tetradecane).

Specific monomers which can be used are lauryl methacrylate, 1,2 dihydronaphthalene, and partially hydrogenated, vinylated hydrogenated anthracene and phenanthrene.

CATALYSTS

Catalysts which can be used are those traditionally used as free radical initiators such as peroxides and hydroperoxides, pinacols, and transitional metal ion initiators. More specifically, catalysts which can be used are 2,2'-axobisisobutyronitrile commonly called AIBN and 1,3diphenyltriazene hereinafter designated DPT. Ot these the DPT catalyst is preferred because it has a longer half-life and can be used at higher temperatures of 100° to 120° C. The working temperature for the AIBN catalyst is 60° to 80° C.

Based on the aggregate weight of carbon black, liquid hydrocarbon and polymerized monomer in the final fuel composition, the amount of carbon black should be between about 5 and about 70 percent by weight, the amount of liquid hydrocarbon between about 30 and about 93 weight percent and the monomer between about 2 and about 15 percent by weight. Preferred weight ranges of these components are between about 50 and about 70 weight percent of carbon black, between about 30 and about 50 percent of hydrocarbon liquid and between about 1 and about 5 weight percent of monomer.

The amount of catalyst incorporated into the mixture will depend in part on the particular catalyst used. When either the AIBN or DPT catalysts are used, between about 1 and about 5 parts by weight of catalyst per 100 parts by weight of monomer are used.

METHOD OF PREPARING LIQUID HYDROCARBON-CARBON BLACK-GRAFT POLYMER COMPOSITIONS

The temperature and pressure at which the carbon black monomer, and catalyst are reacted are those now generally used in ordinary polymerization reactions and will range from about 50° to about 150° C. and from about 0 to about 20 psig.

In combining the carbon black, liquid hydrocarbon fuel, monomer, and catalyst a novel feature of the method of mixing these components is that the carbon black, monomer and catalyst are added to and reacted in the liquid hydrocarbon fuel directly. No intermediate step wherein the carbon black and monomer are first reacted and then added to the liquid hydrocarbon is required.

In a preferred method of combining the components the carbon black, monomer, and catalyst are all added in the desired proportions to the liquid hydrocarbon fuel. The combined materials are agitated at ambient temperature sufficiently to disperse them evenly throughout the hydrocarbon liquid. The mixture is then heated to the temperature required to polymerize the monomer. The time required to complete the reaction varies but a period as low as two hours has been used. Upon completion of the reaction, the mixture is cooled and is ready for use as a fuel.

If desired, however, the carbon black-grafted-polymer can be formed separately from the liquid hydrocarbon fuel and then combined with and dispersed in the liquid hydrocarbon fuel.

It is recognized that the monomer reacts in two different ways. There is a self-polymerization (homopolymerization) reaction in which the monomer molecules link with each other forming a homopolymer of the monomer. The second reaction is one wherein growing polymer chains react with carbon black particles to form grafted-polymer. Ideally the reaction should be conducted to maximize the formation of grafted-polymers with the carbon black and to minimize the formation of homopolymers.

In some instances it is desirable to pretreat the carbon black with a de-gassing treatment. This step constitutes subjecting the carbon black to a vacuum (2 to 5 mm. of mercury) and elevated temperature (140° to 150° C.) for a period about three hours. This treatment removes moisture and oxygen and enhances the activity of the carbon black for attaching hydrocarbon radicals.

EXAMPLE I

To 106.6 grams of hydrocarbon liquid fuel (tradenamed Shelldyne) in a blender a weight of 65 grams of a thermal carbon black was added. Upon blending the two components, a thixotropic dispersion with a density of 1.27 gms/ml and containing 33.7 percent by weight of carbon black was obtained. This mixture, designated as sample A, was set aside to be used as a control and comparison sample.

A second dispersion using the same proportion of thermal black and hydrocarbon liquid was then prepared. While the second dispersion was still in the blender 300 mg. of DPT catalyst was added with continued agitation, and subsequently 21.5 g. of lauryl methacrylate monomer. A portion of the resulting mixture, designated as sample B, was retained at room temperature. The remainder, designated as sample C, weighing 117 grams was removed and heated overnight (15 hours approximately) at a temperature of 100° C. in a closed container. Visual comparison of this last mixture, sample C, with the sample containing no added monomer, sample A, and the sample containing unpolymerized monomer, sample B, showed definitely that the heated, polymerized sample C had the lowest viscosity (comparable to motor oil at room temperature) whereas the first two samples A and B were extremely viscous. This lower viscosity indicated that graft polymerization of the lauryl methacrylate had occurred in the presence of the liquid hydrocarbon fuel carrier. The calculated composition of samples B and C was 55.2 percent Shelldyne, 33.7 percent carbon black, and 11.1 percent monomer and polymer respectively.

EXAMPLE II

To 184 grams of a hydrogenated dimer of methylcyclopentadiene (known commercially as RJ-4) 113 grams of the same thermal black as in Example I was added and blended to give a thixotropic mixture containing 38 percent black. A portion of this mixture (106 grams), designated as sample D, was removed for purposes of control and comparison. To the remaining 191 grams of mixture 23.6 g. of lauryl methacrylate and 330 mg of DPT catalyst were added with agitation. The amount of catalyst added corresponds to 1.4 parts per 100 parts by weight of monomer. The quantities of carbon black, RJ-4 liquid hydrocarbon, lauryl methacrylate, and DPT catalyst mixed correspond to the same weight ratios in Example I. After mixing all of these components a sample portion, designated as sample E, was removed and the remainder, designated as sample F, was heated overnight in a closed container at 110° C. From visual examination the next day, the polymerized sample F was observed to have a considerably lower viscosity than the original comparison sample D and the unpolymerized sample E. The measured viscosity of sample E was 6940 centipoises and that of sample F was only 300 centipoises. The calculated composition of samples E and F was 55.2 percent dimer, 33.8 percent carbon black and 11.0 percent monomer based on the aggregate weight of these three components.

Heats of combustion of samples A, C, D and F when measured were as shown in the following tabulation. The values given for Shelldyne and RJ-4 without added carbon black are those reported in the literature. The calculated values for the liquid fuel-carbon black-monomer-grafted polymer mixtures do not include the heat of combustion of the included monomer and grafted-polymer, whereas the experimental values do.

| | | Heating Value, BTU per gallon | |
|---|---|---|---|
| | | Calculated | Experimental |
| Shelldyne | without added carbon black | | 162,000 |
| Shelldyne | with added carbon black and no added monomer (sample A-37.5% carbon black by wt.) | 178,500 | 183,000 |
| Shelldyne | with grafted polymer and carbon black (sample C - 33.7% carbon black, 11.1 percent monomer, and 55.2% Shelldyne) | 176,000 | 173,700 |
| RJ-4 | without added carbon black | | 142,000 |
| RJ-4 | with added carbon black and no added monomer (sample D-38% carbon black by weight) | 161,500 | 166,600 |
| RJ-4 | with grafted polymer and carbon black (sample F - 33.8% carbon black, 11.0% monomer, and 55.2% RJ-4 fuel) | 159,000 | 165,100 |

While specific examples of the present invention have been set forth above it is to be recognized that they are for purposes of explanation only. Accordingly, the present invention is to be limited only by the appended claims.

What is claimed is:

1. A method for preparing a liquid hydrocarbon fuel composition which comprises slurrying a mixture of from 5–70 weight percent pulverulent carbon black, from 30–93 weight percent of a liquid combustible hydrocarbon and a monomer selected from the group consisting of a vinyl ester, an acrylic acid ester, an acylic diene and a cyclic diene wherein said monomer constitutes from 2–15 weight percent of the aggregate weight of said mixture, heating the mixture with agitation at a temperature of from 60°–120° C. in the presence of from 2–5 weight percent based on the weight of said monomer of a IBN or DPI catalyst to effect the polymerization thereof.

* * * * *